United States Patent [19]

Wang et al.

[11] 4,148,720

[45] Apr. 10, 1979

[54] PROCESS FOR BENEFICIATION OF NON-SULFIDE IRON ORES

[75] Inventors: Samuel S. Wang, New Haven; Eugene L. Smith, Stamford, both of Conn.

[73] Assignee: American Cyanamid Company, Stamford, Conn.

[21] Appl. No.: 793,460

[22] Filed: May 3, 1977

Related U.S. Application Data

[63] Continuation-in-part of Ser. No. 723,840, Sep. 16, 1976, abandoned, which is a continuation-in-part of Ser. No. 686,629, May 14, 1976, abandoned, which is a continuation-in-part of Ser. No. 650,094, Jan. 19, 1976, abandoned.

[51] Int. Cl.[2] ..... B03D 1/02

[52] U.S. Cl. ..... 209/166

[58] Field of Search ..... 209/106, 107; 252/61

[56] References Cited

U.S. PATENT DOCUMENTS

| | | | |
|---|---|---|---|
| 2,099,120 | 11/1957 | Kirby | 209/166 |
| 2,120,217 | 6/1938 | Harris | 209/166 |
| 2,303,238 | 11/1942 | Moeller | 209/166 |
| 2,312,466 | 3/1943 | Erickson | 209/166 |
| 2,362,432 | 11/1944 | Cahn | 209/166 |
| 2,393,008 | 1/1946 | Woodward | 209/166 |
| 2,679,522 | 5/1959 | DeGiote | 260/485 G X |
| 3,059,207 | 1/1975 | Knocke | 209/166 |
| 3,265,211 | 8/1966 | Ray | 209/166 |
| 3,779,380 | 12/1973 | Bishop | 209/166 |
| 4,034,863 | 7/1977 | Wang | 209/166 |

FOREIGN PATENT DOCUMENTS

| | | | |
|---|---|---|---|
| 917912 | 9/1946 | France | 207/166 |
| 1355091 | 5/1974 | United Kingdom | 209/166 |

*Primary Examiner*—Robert Halper

*Attorney, Agent, or Firm*—William J. van Loo

[57] ABSTRACT

Improved beneficiation of non-sulfide iron ores by froth flotation results when the collector employed is a mixture of a naturally derived fatty acid and a partial ester of a polycarboxylic acid having at least one free carboxylic acid group.

10 Claims, 1 Drawing Figure

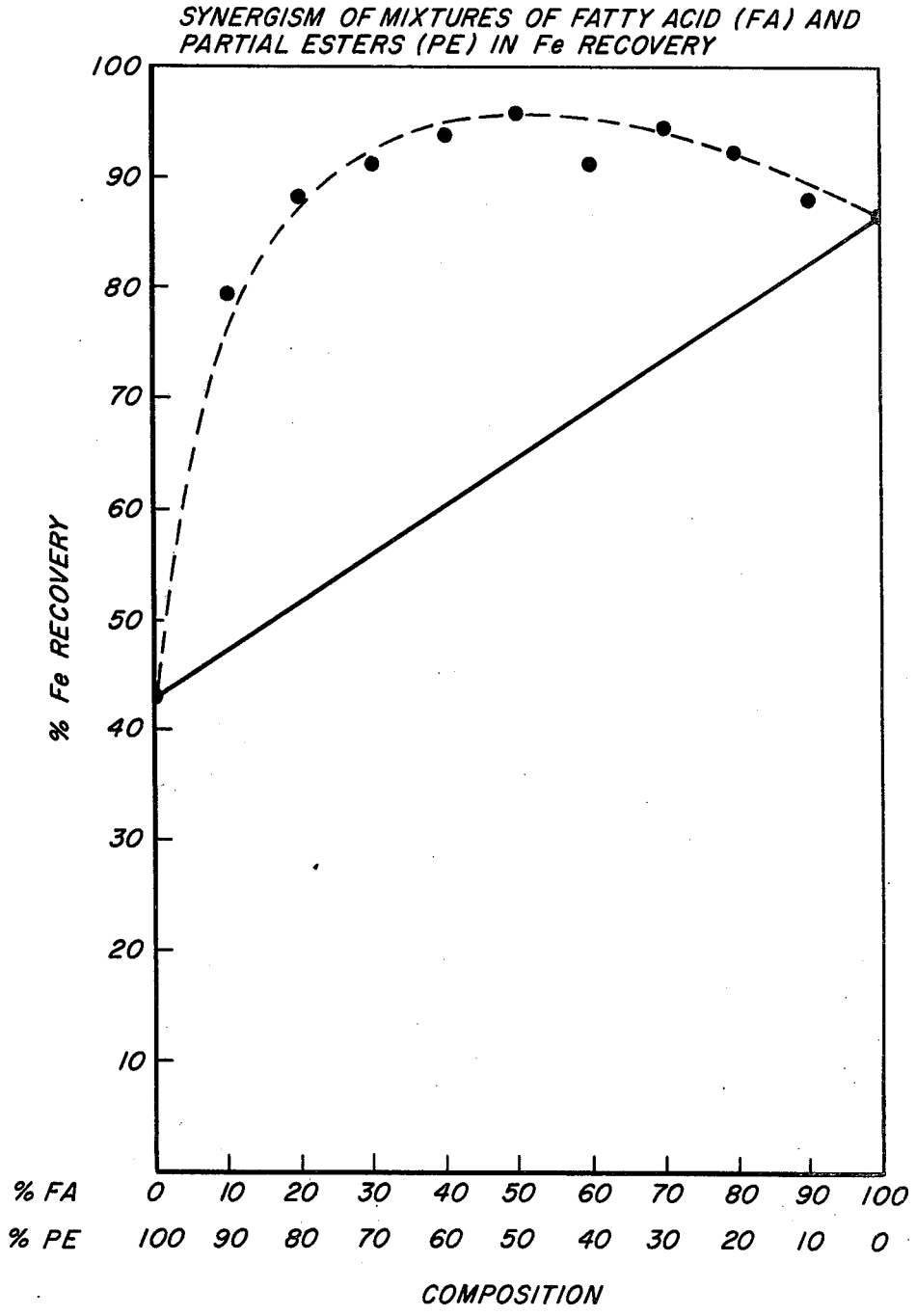
SYNERGISM OF MIXTURES OF FATTY ACID (FA) AND PARTIAL ESTERS (PE) IN Fe RECOVERY
% Fe RECOVERY
100
90
80
70
60
50
40
30
20
10
% FA 0 10 20 30 40 50 60 70 80 90 100
% PE 100 90 80 70 60 50 40 30 20 10 0
COMPOSITION

PROCESS FOR BENEFICIATION OF NON-SULFIDE IRON ORES

This application is a continuation-in-part of application Ser. No. 723,840, filed Sept. 16, 1976, now abandoned which in turn, is a continuation-in-part of application Ser. No. 686,629, filed May 14, 1976, now abandoned which in turn is a continuation-in-part of application Ser. No. 650,094, filed Jan. 19, 1976 now abandoned.

This invention relates to a process for the beneficiation of oxidized type iron ores. More particularly, this invention relates to such a process wherein combinations of common naturally derived fatty acids of vegetable or animal oil sources and maleic half esters of ethoxylated linear alcohols as froth flotation agents provide beneficial effects.

Froth flotation, like gravity concentration and magnetic separation, is one of the several viable means by which valuable products are recovered from reserves of low-grade iron ores which are normally not used as a source of iron. A significant fraction of the vast ore reserves are non-magnetic or oxidized type. The oxidized iron formation consists of chemically precipitated iron oxide, carbonate, silicate, sulfide or phosphate facies which are thinly bounded and interlayered with chert and other waste materials. Hematite/martite is the principal iron ore mineral, although some ores contain significant amounts of goethite. Froth flotation of non-magnetic iron ore is advantageous because it is a relatively efficient process operating at substantially lower cost than many other processes.

Flotation is a process for separating finely ground valuable minerals from their associated gangue, or wastes, or for separating valuable components one from another. In froth flotation, frothing occurs by introducing air into a pulp of finely divided ore and water containing a frothing agent. Minerals that have a special affinity for air bubbles rise to the surface in the froth and are separated from those wetted by the water. The particles to be separated by froth flotation must be of a size that can be readily levitated by the air bubbles.

Agents called collectors are used in conjunction with flotation to promote recovery of the desired material. The agent chosen must be capable of selectively coating the desired material in spite of the presence of many other mineral species. Current theory states that the flotation separation of one mineral species from another depends upon the relative wettability of surfaces. Typically, the surface-free energy is purportedly lowered by the adsorption of heteropolar surface-active agents. The hydrophobic coating thus provided acts in this explanation as a bridge so that the particle may be attached to an air bubble. The practice of this invention is not limited by this or other theories of flotation.

In processing oxidized type iron ores, the ore is sized for flotation, is conditioned with fatty acid and additives such as pH adjustors, frothers, and the like, and is froth floated by conventional froth flotation routes. Depending upon the nature of the ore treated, not all gangue material may be removed in the first, or rougher, flotation and, as necessary, additional, or cleaner, flotations are run, also employing conventional procedures.

Although the procedure described above is effective in recovery of oxidized type iron ores from their gangue materials, there, nevertheless, exists the need for more effective processes which will provide increased recovery of mineral values while still providing high grade recovery. In view of the large quantities of oxidized type ores processed by froth flotation, such a development can result in a substantial increase in the total amount of mineral values recovered and provide substantial economical advantages even when a modest increase in recovery is provided. It is also desirable to have an efficient collector system for use at reduced dosage levels without sacrificing the mineral recovery performance. Decreases in reagent consumption are significant in view of the increasing diversion of naturally derived fatty acids for nutritional and other purposes. The advantages of having a collector system which achieves savings in usage of petroleum based fuel oil for optimum mineral recovery are readily apparent to an energy intensive society. Accordingly, the provision for an improved process for froth flotation of oxidized type iron minerals would fulfill a long-felt need and constitute a notable advance in the art.

In accordance with the present invention, there is provided a process for the beneficiation of oxidized type iron ores which comprises classifying the ore to provide particles of flotation size, slurrying the sized ore in aqueous medium, conditioning the slurry with an effective amount of a combination of from about 99 to about 5 weight percent of a fatty acid derived from a vegetable or animal oil and, correspondingly, from about 1 to about 95 weight percent of a partial ester of a polycarboxylic acid having at least one free carboxylic acid group, and floating the desired ore values by froth flotation, said partial ester having the structure:

$$R'-O(CH_2CH_2O)_n-CH_2CH_2O-\overset{O}{\overset{\|}{C}}-R-\overset{O}{\overset{\|}{C}}-OH$$

wherein R′ is, a primary or secondary alkyl group of about 8 to 18 carbon atoms, n is an integer of about 0–10 and R is a bivalent grouping selected from $-(CH_2)_m$ wherein m is an integer of 1 to 6, —CH =CH—, —CHOHCH₂—, —CHOHCHOH—,

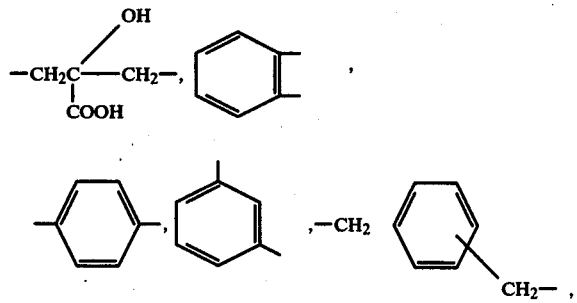

ortho, para, and meta, and $-C_6H_{10}-$.

The combination of fatty acid and partial ester enables the requirements for scarce fatty acids to be reduced while providing high recovery and grade. In most instances, the combination provides superior performance over that obtainable with either component alone. In many instances, the combination reduces dosage requirements for collector for the same recovery and grade of mineral values. In all cases, the requirements for scarce fatty acid can be significantly reduced, while, generally, providing a boost in the recovery obtained. In certain instances, the partial ester alone cannot be effectively employed because of excessive foaming associated with such use. Attempts to abate foaming by special additives adversely affect recovery and unnecessarily increase costs. However, combinations as used in the present invention do not cause excessive foaming and provide an increase in recovery over that obtained with the fatty acid alone.

The partial esters are obtained by synthesis utilizing specific polycarboxylic acids as esterifying agents. The alcohol ethoxylates may be derived from a single component or admixture of two or more alcohols. These synthetic partial esters are moderate in cost and are more readily available than currently used reagents. The synthetic acid can be produced in more consistent, predictable purity and quality than naturally derived scarce products.

The invention is described with reference to the accompanying drawing which shows expected and actual performance of combinations of fatty acid and partial ester in iron recovery.

In carrying out the process of the present invention, an oxidized type of iron ore is selected for treatment. The ore can consist primarily of hematite and martite with various proportions of goethite.

After the selected ore has been sized as indicated, it is slurried in aqueous medium and conditioned with the combination of fatty acid and partial ester as well as such other additives as may be conventionally employed with the selected ore. Such additives may include alkali or other pH adjusters, frother, fuel oil, foam control agents, and the like as are well known to the skilled artisan. Depending upon the particular ore to be processed, the content of mineral solids in the slurry will vary according to conventional processing. Generally, the combination of fatty acid and partial ester is used in an amount to provide a level of about 0.1 to 2.0 of the combination per ton of ore, although variations in amounts will vary with the specific ore being processed within conventional ranges.

The fatty acid used in the combination is one derived from a vegetable or animal oil. Vegetable oils include babassu, castor, chinese tallow, coconut, cottonseed, grapeseed, hempseed, kapok, linseed, wild mustard, oiticica, olive, ouri-ouri, palm, palm-kernel, peanut, perilla, poppyseed, Argentina rapeseed, rubberseed, safflower, sesame, soybean, sugarcane, sunflower, tall, teaseed, tung and ucuhuba oil. Animal oils include fish and livestock oils. These oils contain acids ranging from six to twenty-eight carbons or more which may be saturated or unsaturated, hydroxylated or not, linear or cyclic, and the like.

The partial ester used in the combination is derived from a polycarboxylic acid in which at least one free carboxylic acid group is present after esterification and which partial ester has a structure given by $$R'-O-(CH_2CH_2O)_n-CH_2CH_2O-\overset{O}{\overset{\|}{C}}-R-\overset{O}{\overset{\|}{C}}-OH$$

wherein R' is a primary or secondary alkyl group of about 8 to 18 carbon atoms, n is an integer of 0–10 and R is a bivalent grouping selected from $-(CH_2)_m-$ wherein m is an integer of 1–6; —CH=CH—;

$$-\underset{OH}{\underset{|}{CH}}-CH_2-;\ -\underset{OH}{\underset{|}{CH}}-\underset{OH}{\underset{|}{CH}}-;$$

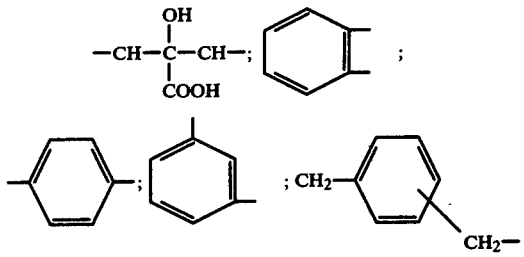

ortho, meta, and para; and $-C_6H_{10}-$.

Typically, the useful partial esters are reaction products of an alcohol ethoxylate of the general structure R'-O-$(CH_2CH_2O)_n$ $CH_2CH_2OH$ wherein R' is a primary or secondary alkyl group of 8 to 18 carbon atoms and n is as defined above and di- or tribasic acids such as malic, maleic, citric, tartaric, succinic, adipic, phthalic, cyclohexyl, dicarboxylic, terephthalic, and similar acids. The alcohol ethoxylates may be derived from a single component or admixture of two or more alcohols. Preferably, the polycarboxylic acid used in forming the partial ester is maleic acid. Preferably the alcohol ethoxylate is such that the alkyl group contains 11 to 15 carbon atoms and n is 2. Suitable partial esters include those of the following structures:

$$C_{(11-15)}H_{(23-30)}O-(CH_2CH_2O)_2-CH_2CH_2O\overset{O}{\overset{\|}{C}}-CH=CH-COOH;$$

$$C_{(12-14)}H_{(25-29)}O-(CH_2CH_2O)_2-CH_2CH_2O\overset{O}{\overset{\|}{C}}-CH=CH-COOH;$$

$$C_{(12-14)}H_{(25-29)}O-(CH_2CH_2O)_2-CH_2CH_2O\overset{O}{\overset{\|}{C}}-\overset{OH}{\overset{|}{C}}HCH_2COOH;$$

$$C_{(12-14)}H_{(25-29)}O-(CH_2CH_2O)_2-CH_2CH_2O\overset{O}{\overset{\|}{C}}-CH_2-\underset{COOH}{\underset{|}{\overset{OH}{\overset{|}{C}}}}-COOH;$$

$$C_{(16-18)}H_{(33-37)}O-(CH_2CH_2O)_2-CH_2CH_2O-\overset{O}{\overset{\|}{C}}-CH_2-\underset{COOH}{\underset{|}{\overset{OH}{\overset{|}{C}}}}-CH_2COOH;$$

-continued

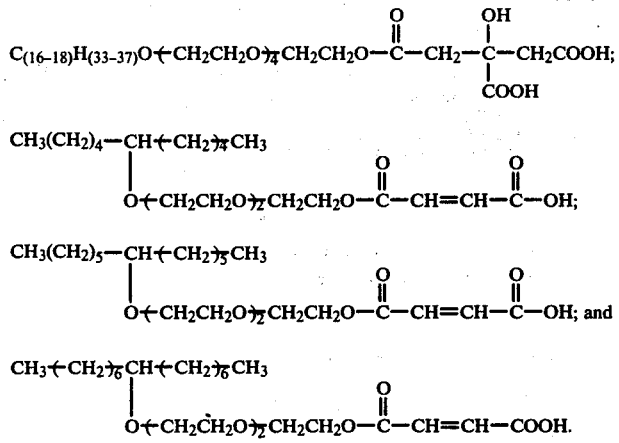

The acid and partial ester are used in the combination such that the fatty acid will constitute from about 99 to about 5 weight percent and, correspondingly, the partial ester will constitute from about 1 to about 95 weight percent of the combination. The combination providing maximum recovery will vary depending upon the specific ore processed and will vary among different samples of the same ore.

The principles of the present invention apply to oxidized type iron ores that are processable by froth flotation. These ores include martite, hematite, and geothite and these ores respond similarly when processed by froth flotation. Other oxidized type iron ores may also be present and will respond similarly.

The invention is more fully illustrated by the examples which follow, wherein all parts and percentages are by weight unless otherwise specified. The following General Procedure was followed, except as indicated in appropriate examples.

GENERAL PROCEDURE

The iron ore samples tested was obtained from Republic Mine in Marquette County, Michigan, and designated as primary conditioner feed. This was the ground and deslimed product to be floated in the plant and was removed from the circuit before it reached the primary flotation conditioner. The dried sample consisted of specular hematite in a lavender colored chert gangue, and assayed approximately 37% Fe.

A laboratory flotation machine was used to condition the pulp at natural pH 7.3 (except where noted) at 50% solids for two minutes. Collector was added in the conditioning step. Pulp was then diluted to 20% solids and froth collected for 3 ½ minutes. The particular dosage of collector was expressed as pound per ton based on the deslimed flotation feed ore.

EXAMPLE 1

A series of runs were made following the General Procedure using the collectors at 0.3 lb/ton. In separate runs a fatty acid was employed alone, a partial ester was employed alone, and various combinations of fatty acid and partial ester were employed. The fatty acid was derived from tall oil. The partial ester had the following structure:

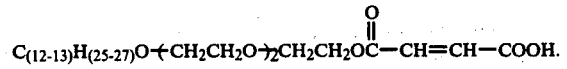

The various compositions evaluated and the results are given in Table 1.

TABLE I

Synergistic Effect of Combinations of Fatty Acid And Partial Ester In Iron Recovery

| Collector[1] % FA/% PE | Weight Recovered (%) | % Fe Feed | % Fe Tails | % Fe Concentrate | Recovery % Fe |
|---|---|---|---|---|---|
| 0/100 | 34.1 | 36.93 | 31.2 | 48.0 | 44.3 |
| 10/90 | 68.0 | 37.47 | 23.6 | 44.0 | 79.9 |
| 20/80 | 78.3 | 37.67 | 20.6 | 42.4 | 88.1 |
| 30/70 | 85.3 | 36.96 | 21.6 | 39.6 | 91.4 |
| 40/60 | 87.9 | 37.43 | 18.8 | 40.0 | 93.9 |
| 50/50 | 91.1 | 35.30 | 15.8 | 37.2 | 96.0 |
| 60/40 | 89.0 | 38.33 | 24.8 | 40.0 | 92.9 |
| 70/30 | 85.4 | 37.09 | 22.4 | 39.6 | 91.2 |
| 80/20 | 86.1 | 37.93 | 15.2 | 41.6 | 94.4 |
| 90/10 | 79.4 | 38.82 | 15.0 | 45.0 | 92.0 |
| 95/5 | 72.8 | 37.44 | 17.2 | 45.0 | 87.5 |
| 100/0 | 71.4 | 37.06 | 17.5 | 44.9 | 86.5 |

Note:
[1]FA = fatty acid: PE = partial ester.

The results obtained show the synergism that is obtained by use of combinations of the fatty acid and partial ester in accordance with the present invention. The results of iron recovery were plotted against composition of the collector and is shown in the accompanying figure. The straight line connects the values obtained with the fatty acid alone and with the partial ester alone. Points on the straight line at specific combinations of fatty acid and partial ester are those values of iron recovery that would normally be expected. The curved line connects actual recovery values obtained with the combinations indicated and since it falls well above the straight line, represents synergism.

EXAMPLE 2

The procedure of Example 1 was again repeated except that the effect of increasing dosage of two combinations of the fatty acid and partial ester used in Example 1 was evaluated. Details and results are given in Table II.

TABLE II

Booster Action Of Combinations Of FA and PE

| Collector | Lbs/ Ton | Wt. % Recovery | % Fe Feed | % Fe Tails | % Fe Conc. | Recovery % Fe |
|---|---|---|---|---|---|---|
| 100% FA | 0.30 | 71.4 | 37.06 | 17.5 | 44.9 | 86.5 |
| 100% FA | 0.45 | 79.8 | 37.82 | 15.0 | 43.6 | 92.0 |
| 100% FA | 0.60 | 78.0 | 34.01 | 12.0 | 43.6 | 92.8 |
| 100% FA | 0.75 | 86.5 | 36.99 | 10.0 | 41.2 | 96.4 |
| 90/10 FA/PE | 0.30 | 79.4 | 38.82 | 15.0 | 45.0 | 92.0 |

TABLE II-continued

| Booster Action Of Combinations Of FA and PE | | | | | | |
|---|---|---|---|---|---|---|
| Collector | Lbs/ Ton | Wt. % Recovery | % Fe Feed | % Fe Tails | % Fe Conc. | Recovery % Fe |
| 90/10 FA/PE | 0.45 | 86.4 | 38.22 | 11.0 | 42.5 | 96.1 |
| 90/10 FA/PE | 0.60 | 89.3 | 39.02 | 10.0 | 42.5 | 97.3 |
| 90/10 FA/PE | 0.75 | 90.7 | 38.28 | 7.8 | 41.4 | 98.1 |
| 95/5 FA/PE | 0.30 | 72.8 | 37.44 | 17.2 | 45.0 | 87.5 |
| 95/5 FA/PE | 0.45 | 77.6 | 37.35 | 13.6 | 44.2 | 91.8 |
| 95/5 FA/PE | 0.60 | 81.7 | 36.02 | 12.0 | 41.4 | 93.9 |
| 95/5 FA/PE | 0.75 | 85.0 | 36.23 | 9.8 | 40.9 | 95.9 |

EXAMPLE 3

The procedure of Example 2 was repeated except that the partial ester had the following structure:

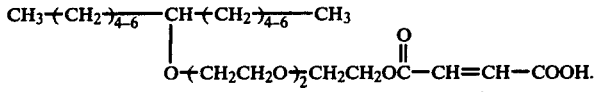

Details and results are given in Table III.

TABLE III

| Booster Action Of Combinations Of FA and PE | | | | | | |
|---|---|---|---|---|---|---|
| Collector | Lbs/ Ton | Wt. % Recovery | % Fe Feed | % Fe Tails | % Fe Conc. | Recovery % Fe |
| 90/10 FA/PE | 0.30 | 79.1 | 36.87 | 16.7 | 42.2 | 90.5 |
| 90/10 FA/PE | 0.45 | 91.0 | 37.89 | 10.4 | 40.6 | 97.5 |
| 90/10 FA/PE | 0.60 | 93.3 | 37.22 | 8.2 | 39.3 | 98.5 |
| 95/5 FA/PE | 0.30 | 77.1 | 36.66 | 16.7 | 42.6 | 89.6 |
| 95/5 FA/PE | 0.45 | 84.3 | 36.66 | 11.2 | 41.4 | 95.2 |
| 95/5 FA/PE | 0.60 | 88.5 | 36.90 | 8.4 | 40.6 | 97.4 |

EXAMPLE 4

The procedure of Example 3 was repeated except that the partial ester had the following structure:

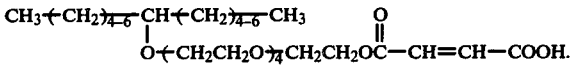

Details and results are given in Table IV.

TABLE IV

| Booster Action Of Combination Of FA and PE | | | | | | |
|---|---|---|---|---|---|---|
| Collector | Lbs/ Ton | Wt. % Recovery | % Fe Feed | % Fe Tails | % Fe Conc. | Recovery % Fe |
| 90/10 FA/PE | 0.30 | 87.8 | 38.07 | 12.0 | 41.7 | 96.2 |
| 90/10 FA/PE | 0.45 | 92.0 | 37.34 | 10.2 | 39.7 | 97.8 |
| 90/10 FA/PE | 0.60 | 95.3 | 36.32 | 8.4 | 37.7 | 98.9 |

EXAMPLE 5

The procedure of Example 3 was again repeated except that the partial ester had the following structure:

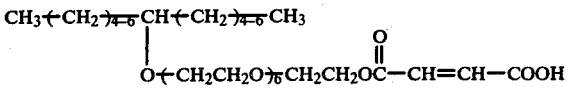

Details and results are given in Table V.

TABLE V

| Booster Action Of Combination Of FA and PE | | | | | | |
|---|---|---|---|---|---|---|
| Collector | Lbs/ Ton | Wt. % Recovery | % Fe Feed | % Fe Tails | % Fe Conc. | Recovery % Fe |
| 90/10 FA/PE | 0.30 | 83.7 | 39.64 | 15.6 | 42.5 | 93.6 |

TABLE V-continued

| Booster Action Of Combination Of FA and PE | | | | | | |
|---|---|---|---|---|---|---|
| Collector | Lbs/ Ton | Wt. % Recovery | % Fe Feed | % Fe Tails | % Fe Conc. | Recovery % Fe |
| 90/10 FA/PE | 0.45 | 88.1 | 37.65 | 19.5 | 40.1 | 93.8 |
| 90/10 FA/PE | 0.60 | 95.0 | 37.33 | 9.4 | 39.3 | 98.8 |

EXAMPLE 6

The procedure of Example 3 was again repeated except that the partial ester had the following structure:

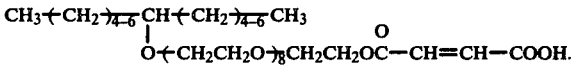

Details and results are given in Table VI.

TABLE VI

| Booster Action Of Combination Of FA and PE | | | | | | |
|---|---|---|---|---|---|---|
| Collector | Lbs/ Ton | Wt. % Recovery | Feed | Tails | Conc. | Recovery % Fe |
| 90/10 FA/PE | 0.30 | 79.1 | 36.83 | 19.9 | 41.3 | 88.7 |
| 90/10 FA/PE | 0.45 | 94.3 | 37.60 | 9.4 | 39.3 | 98.6 |
| 90/10 FA/PE | 0.60 | 96.6 | 37.45 | 7.8 | 38.5 | 99.3 |

We claim:

1. A process for the beneficiation of oxidized type iron ores which comprises classifying the ore to provide particles of flotation size, slurrying the sized ore in aqueous medium, conditioning the slurry with an effective amount of a combination of from about 99 to about 5 weight percent of a fatty acid derived from a vegetable or animal oil and, correspondingly, from about 1 to about 95 weight percent of a partial ester of a polycarboxylic acid having at least one free carboxylic acid group, and floating the desired ore values by froth flotation, said partial ester having the structure:

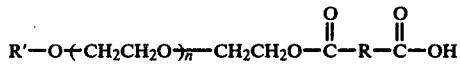

wherein R′ is a primary or secondary alkyl group of about 8 to 18 carbon atoms, n is an integer of about 0–10 and R is a bivalent grouping selected from $-(CH_2)_m-$ wherein m is an integer of 1 to 6, —CH=CH—, —CHOHCH₂—, —CHOHCHOH—,

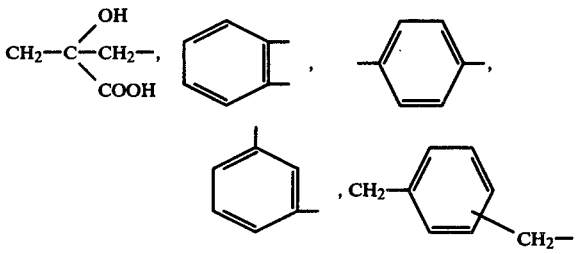

ortho, meta, and para, and $-C_6H_{10}-$.

2. The process of claim 1 wherein R′ in said structure is a primary alkyl group.

3. The process of claim 2 wherein n in said structure is 2.

4. The process of claim 3 wherein said secondary alkyl group contains 11–15 carbon atoms.

5. The process of claim 2 wherein said primary alkyl group contains 12–14 carbon atoms.

6. The process of claim 1 wherein R′ in said structure is a secondary alkyl group.

7. The process of claim 4 wherein n in said structure is 5.

8. The process of claim 1 wherein said alkyl group contains 11 to 15 carbon atoms.

9. The process of claim 1 wherein the combination contains from about 90 to 95 weight percent of fatty acid and, correspondingly, from about 5 to 10 weight percent of partial ester.

10. The process of claim 1 wherein said fatty acid is derived from tall oil.

* * * * *